US012286761B2

(12) United States Patent
Matsubara et al.

(10) Patent No.: US 12,286,761 B2
(45) Date of Patent: Apr. 29, 2025

(54) FOUNDATION FORMWORK

(71) Applicant: Sekisui House, LTD., Osaka (JP)

(72) Inventors: Yoshiyuki Matsubara, Osaka (JP); Yoshinori Sumitomo, Osaka (JP); Seishi Hirano, Osaka (JP)

(73) Assignee: Sekisui House, LTD., Osaka (JP)

( * ) Notice: Subject to any disclaimer, the term of this patent is extended or adjusted under 35 U.S.C. 154(b) by 307 days.

(21) Appl. No.: 17/925,670

(22) PCT Filed: May 18, 2021

(86) PCT No.: PCT/JP2021/018745
§ 371 (c)(1),
(2) Date: Nov. 16, 2022

(87) PCT Pub. No.: WO2021/246157
PCT Pub. Date: Dec. 9, 2021

(65) Prior Publication Data

US 2023/0193578 A1 Jun. 22, 2023

(30) Foreign Application Priority Data

Jun. 1, 2020 (JP) ..... 2020-095385

(51) Int. Cl.
*E02D 27/01* (2006.01)
*E04G 9/05* (2006.01)
(Continued)

(52) U.S. Cl.
CPC ..... *E02D 27/013* (2013.01); *E04G 9/05* (2013.01); *E04G 9/10* (2013.01); *E04G 11/08* (2013.01);
(Continued)

(58) Field of Classification Search
CPC ..... E02D 27/013; E04G 9/05; E04G 9/10; E04G 11/08; E04G 13/00; E04G 17/12; E04G 21/185
See application file for complete search history.

(56) References Cited

U.S. PATENT DOCUMENTS 5,511,761 A * 4/1996 Schultz ..... E04G 11/10 249/34
5,922,236 A * 7/1999 Zuhl ..... E04G 13/00 249/34
(Continued)

FOREIGN PATENT DOCUMENTS

CN 111021708 A * 4/2020
EP 2530214 A1 * 12/2012 ..... E04G 9/05
(Continued)

*Primary Examiner* — Jessie T Fonseca
(74) *Attorney, Agent, or Firm* — Jordan and Koda, PLLC; Steven P. Koda, Esq.

(57) ABSTRACT

A light-weight formwork having a small change in dimensions due to an environmental temperature. A foundation formwork includes a metal frame having a rectangular frame shape, and a resin faceplate attached to the metal frame and closing an opening of the metal frame. The metal frame includes a top plate having fitting notches and L-shaped bridged bodies. The resin faceplate includes protruding bodies fitted with the fitting notches and L-shaped slits into which the bridged bodies are fittingly inserted. The protruding bodies fit with the fitting notches and the bridged bodies are fittingly inserted into the slits, thereby the resin faceplate is attached to the metal frame. The attached resin faceplate closes an opening of the metal frame. The fitting notches and the bridged bodies suppress an expansion and contraction of the resin faceplate in a left and right direction.

4 Claims, 4 Drawing Sheets

(51) Int. Cl.

| | |
|---|---|
| ***E04G 9/10*** | (2006.01) |
| ***E04G 11/08*** | (2006.01) |
| ***E04G 13/00*** | (2006.01) |
| ***E04G 17/12*** | (2006.01) |
| ***E04G 21/18*** | (2006.01) |

(52) U.S. Cl.
CPC ..... *E04G 13/00* (2013.01); *E04G 17/12* (2013.01); *E04G 21/185* (2013.01)

(56) References Cited

U.S. PATENT DOCUMENTS

| | | | | |
|---|---|---|---|---|
| 2005/0126098 | A1* | 6/2005 | Walters | E04G 13/00 52/424 |
| 2009/0146043 | A1* | 6/2009 | Gates | E04G 13/00 249/126 |
| 2015/0069647 | A1* | 3/2015 | Ciuperca | C04B 7/02 249/13 |

FOREIGN PATENT DOCUMENTS

| | | | | | |
|---|---|---|---|---|---|
| JP | 51-85060 | U | | 7/1976 | |
| JP | 52-16731 | U | | 2/1977 | |
| JP | 08-151788 | A | | 6/1996 | |
| JP | 10-008474 | A | | 1/1998 | |
| JP | 10-140823 | A | | 5/1998 | |
| JP | 2000220292 | A | * | 8/2000 | |
| JP | 2006-283365 | A | | 10/2006 | |
| KR | 20100001354 | A | * | 1/2010 | |
| WO | 02/22991 | A1 | | 3/2002 | |
| WO | 2012/058696 | A2 | | 5/2012 | |
| WO | WO-2012090716 | A1 | * | 7/2012 | E04G 17/065 |

* cited by examiner

FOUNDATION FORMWORK

BACKGROUND OF THE INVENTION

The present invention relates to a foundation formwork used for placing a foundation.

Patent Document 1 discloses a foundation formwork in which a mesh-like body obtained by assembling a plurality of rebars in a mesh manner is attached to an inside of a plate body formed of FRP, the plate body having a substantially unrounded U-shaped cross section.

PRIOR ART DOCUMENT

Patent Document

Patent Document 1: Japanese Patent Application Laid-Open No. 10-8474

SUMMARY OF THE INVENTION

When a foundation formwork formed of resin is used, the foundation formwork becomes light and handling of the foundation formwork becomes easy. However, the foundation formwork formed of resin has a risk of expanding or contracting due to differences in an environmental temperature between summer and winter and causing a change in dimensions to an extent that affects an execution of a building. In such a case, a foundation needs to be placed considering the change in the dimensions of the foundation formwork, and it takes time and effort to place the foundation. On the other hand, the change in the dimensions due to the environmental temperature is smaller in a foundation formwork formed of metal than in the formwork formed of resin. However, the foundation formwork formed of metal is heavier and harder to handle than the foundation formwork formed of resin.

It is an object of the present invention to provide a light-weight foundation formwork having a small change in dimensions due to the environmental temperature.

(1) A foundation formwork according to the present invention includes a metal frame having a rectangular frame shape, and a resin faceplate attached to the metal frame and closing an opening of the metal frame.

The foundation formwork according to the present invention is configured by the metal frame and the resin faceplate attached to the metal frame. Therefore, it is lighter than a conventional foundation formwork entirely formed of metal. Being lighter than the conventional foundation formwork, it is easy to handle. In other words, the foundation formwork according to the present invention can facilitate work of a worker installing the foundation formwork. Furthermore, regarding the foundation formwork according to the present invention, since a frame part having the rectangular frame shape is formed of metal, a dimensional change due to an environmental temperature is small. In other words, in the foundation formwork according to the present invention, the frame part having the rectangular frame shape is formed of metal and a faceplate part closing an opening of the frame formed of metal is formed of resin, thereby the dimensional change due to the environmental temperature is smaller than in a conventional foundation formwork entirely formed of resin. As a result, the foundation formwork according to the present invention can place a more accurate foundation than the conventional foundation formwork entirely formed of resin.

(2) The metal frame may have a first fitting part being one of a pair of fitting parts fitted with each other, and the resin faceplate may have a second fitting part being another one of the pair of fitting parts.

The first fitting part and the second fitting part are fitted, thereby the resin faceplate is attached to the metal frame. In other words, the resin faceplate is detachably attached to the metal frame. Therefore, the resin faceplate can be easily replaced with a new resin faceplate when deteriorated or damaged.

(3) The metal frame may have a pair of left and right frame bodies facing each other in a horizontal direction when put on a ground, a pair of upper and lower frame bodies facing each other in a vertical direction when put on the ground, and a bridged body bridged between the pair of upper and lower frame bodies along the left and right frame bodies, the bridged body being the first fitting part. The resin faceplate has a faceplate main body having a plate shape, and a protruding body protruding from a main surface of the faceplate main body. The second fitting part is a slit provided from one end to another end of the protruding body and configured so that the bridged body is fittingly insertable from a side of the one end.

The bridged body is inserted into the slit, thereby the resin faceplate is attached to the metal frame.

(4) The bridged body may have a first piece abutting on a peripheral surface of the slit in a left and right direction being a direction along which the upper and lower frame bodies follow, and a second piece abutting on the peripheral surface of the slit in a forward and backward direction orthogonal to both an up and down direction along which the left and right frame bodies follow and the left and right direction.

The first piece abuts on the peripheral surface of the slit in the left and right direction, thereby the resin faceplate is fixed to the metal frame in the left and right direction, and the second piece abuts on the peripheral surface of the slit in the forward and backward direction, thereby the resin faceplate is fixed to the metal frame in the forward and backward direction. In other words, the resin faceplate is fixed to the metal frame in the left and right direction and the forward and backward direction.

(5) At least one of the upper and lower frame bodies may have a recessed part configured to allow the protruding body to be fitted and having a peripheral surface abutting on the protruding body in a left and right direction being a direction along which the upper and lower frame bodies follow.

A protrusion of the resin faceplate abuts on the recessed part of the upper and lower frame bodies in the left and right direction, thereby an expansion and contraction of the resin faceplate in a width direction due to the environmental temperature can be further suppressed.

The foundation formwork according to the present invention is light and has a small change in dimensions due to an environmental temperature.

DETAILED DESCRIPTION OF PREFERRED EMBODIMENTS OF THE INVENTION

Hereinafter, an embodiment of the present invention is described. Note that it is needless to state that the embodiment described below is merely an example of the present invention and that the embodiment of the present invention can be changed as appropriate without changing the gist of the present invention.

Figure 1:
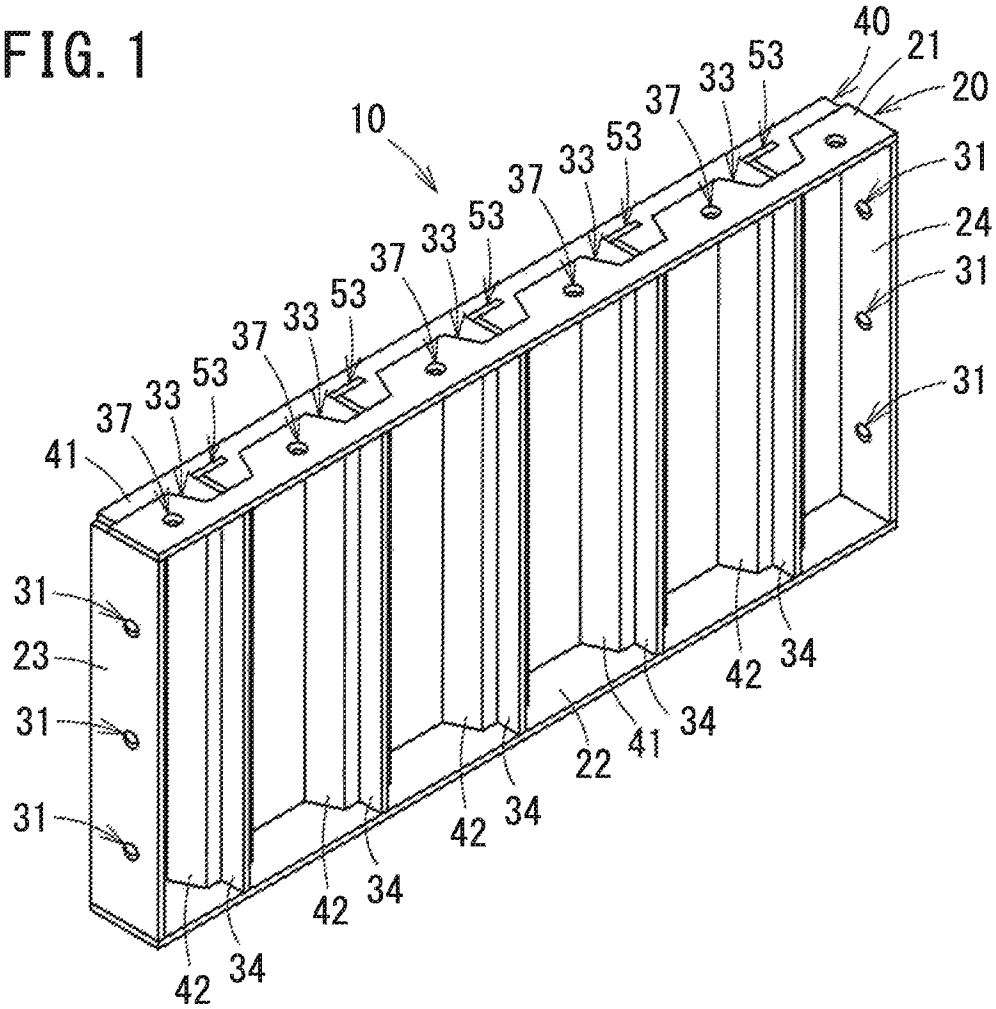
FIG. 1 is a perspective view of a foundation formwork 10.
Figure 2:
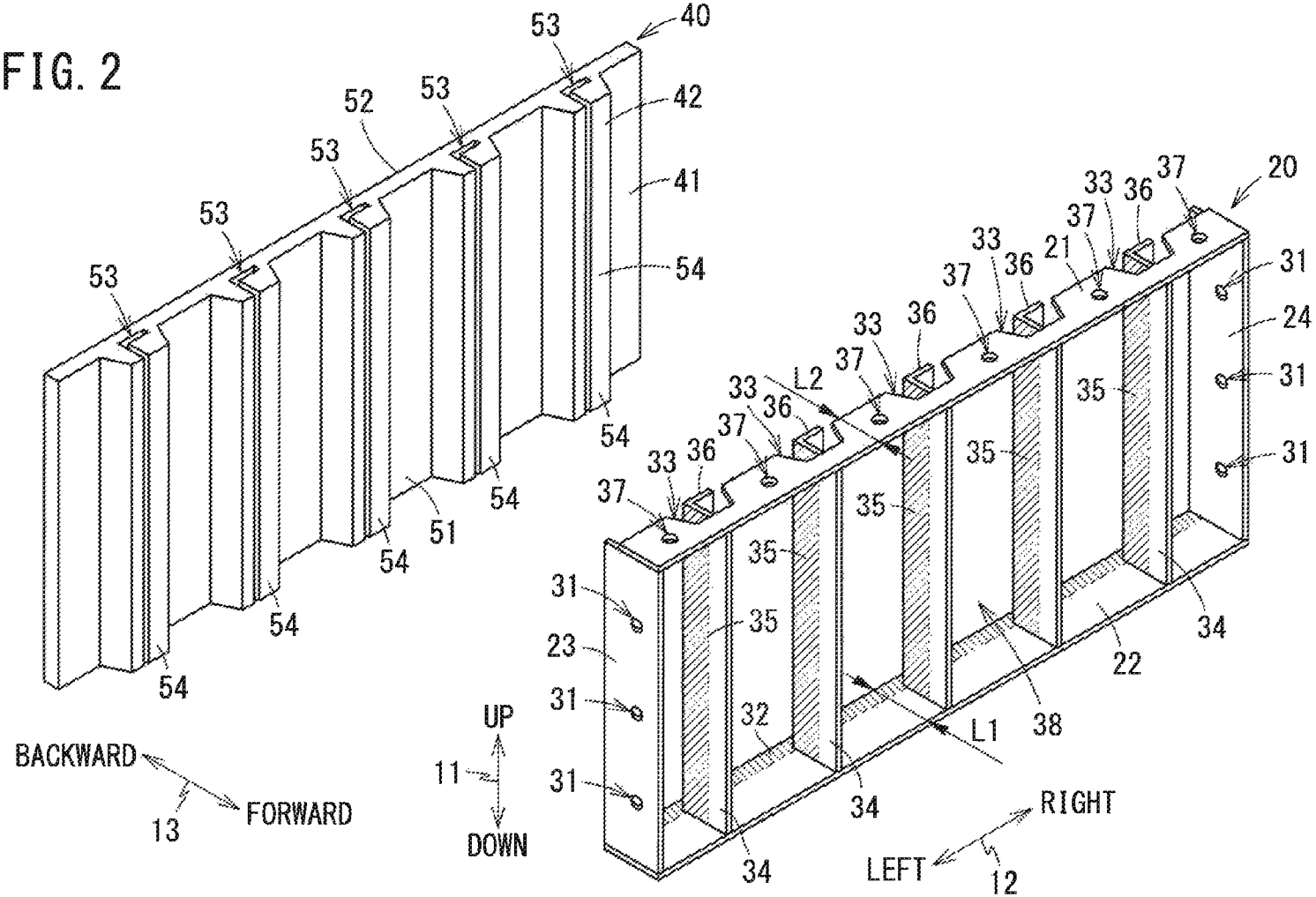
FIG. 2 is an exploded perspective view of the foundation formwork 10.

In the present embodiment, a foundation formwork 10 (FIG. 1) used for placing a foundation is described. As illustrated in FIGS. 1 and 2, the foundation formwork 10 includes a metal frame 20 and a resin faceplate 40.

The metal frame 20 is formed of metal, such as a steel material. The metal frame 20 is manufactured by bending or welding a steel plate, for example.

The metal frame 20 has a rectangular frame shape and has an opening 38.

Figure 4:
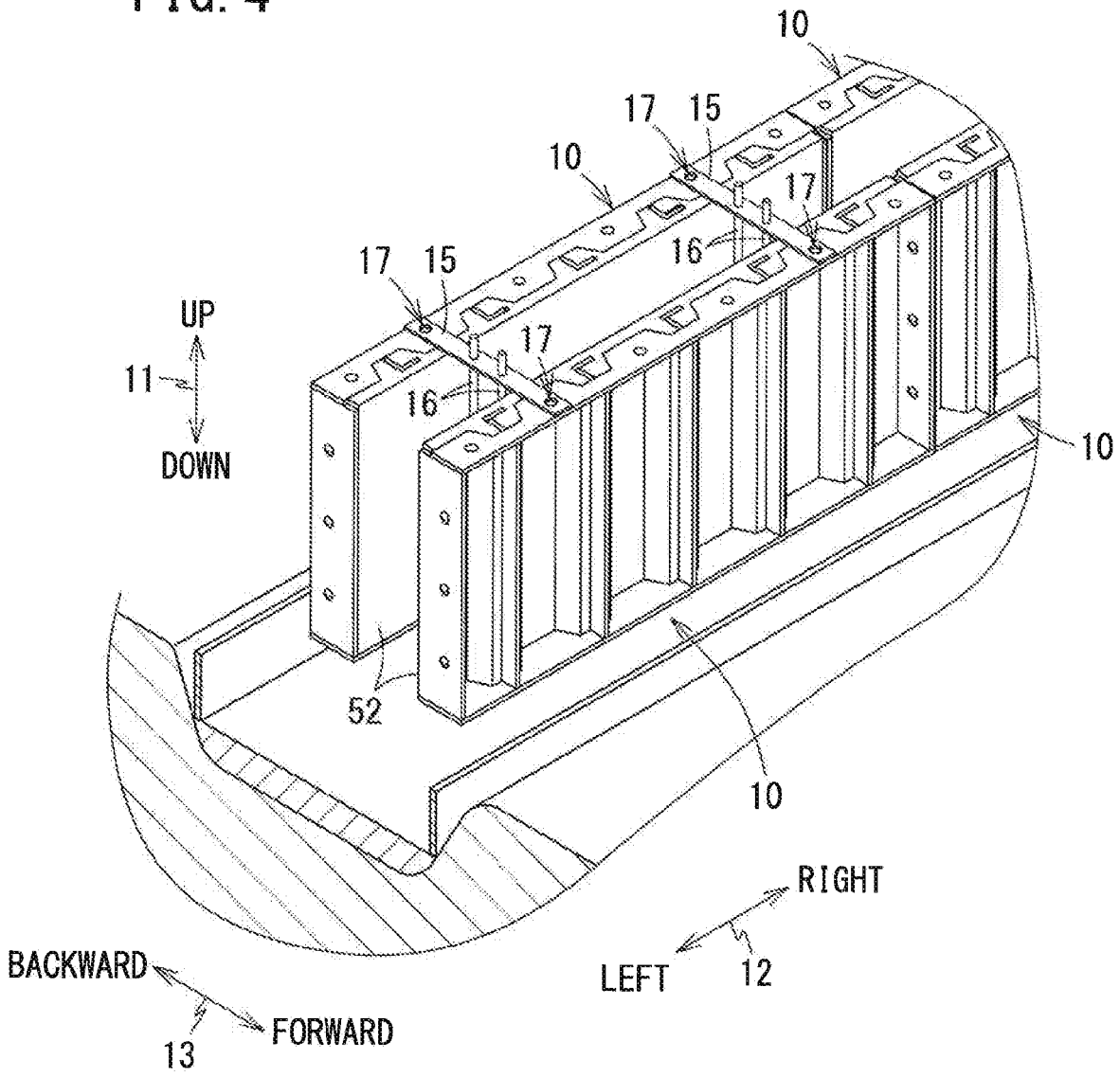
FIG. 4 is an explanatory view for explaining a placement of a foundation using the foundation formworks 10.

The metal frame 20 includes a top plate 21 and a bottom plate 22 facing each other, and a pair of side plates 23, 24 facing each other. As illustrated in FIG. 4, the foundation formwork 10 is installed for use on a ground, a leveling concrete, or the like using an installing tool, with the bottom plate 22 located downward and the top plate 21 located upward. Hereinafter, a description is provided referring a vertical direction in a state in which the foundation formwork 10 is used as an up and down direction 11, referring a direction along which the top plate 21 and the bottom plate 22 extend as a left and right direction 12, and referring a direction orthogonal to both the up and down direction 11 and the left and right direction 12 as a forward and backward direction 13. The pair of left and right side plates 23, 24 are an example of left and right frame bodies. The top plate 21 and the bottom plate 22 are an example of upper and lower frame bodies.

As illustrated in FIG. 2, the pair of left and right side plates 23, 24 each have a rectangular plate shape extending in the up and down direction 11 and having a thickness in the left and right direction 12.

The length of the side plate 23 in the up and down direction 11 and the length of the side plate 24 in the up and down direction 11 are substantially the same. Furthermore, the length of the side plate 23 in the forward and backward direction 13 and the length of the side plate 24 in the forward and backward direction 13 are substantially the same. In other words, the pair of left and right side plates 23, 24 has substantially the same shape.

The pair of left and right side plates 23, 24 each have coupling holes 31 penetrating the side plates 23, 24 in the left and right direction 12, which is a thickness direction. The coupling holes 31 are used for coupling two of the foundation formworks 10. More specifically, an outer side surface of the side plate 23 of one foundation formwork 10 and an outer side surface of the side plate 24 of the other foundation formwork 10 are caused to abut with overlapping the coupling holes 31. Bolts (not illustrated) are inserted through the overlapped coupling holes 31. Nuts are fastened to the bolts. The two foundation formworks 10 are coupled by the bolts and the nuts. In this manner, a plurality of foundation formworks 10 are aligned side by side in the left and right direction 12 and are coupled to each other (FIG. 4).

The top plate 21 has a rectangular plate shape extending in the left and right direction 12 and having a thickness in the up and down direction 11. The bottom plate 22 has a rectangular plate shape extending in the left and right direction 12 and having a thickness in the up and down direction 11. In other words, the top plate 21 and the bottom plate 22 face each other in the up and down direction 11, which is a thickness direction.

The length of the top plate 21 in the left and right direction 12 and the length of the bottom plate 22 in the left and right direction 12 are substantially the same. The left end of the top plate 21 is coupled to the upper end of the side plate 23 in the up and down direction 11, and the right end of the top plate 21 is coupled to the upper end of the side plate 24 in the up and down direction 11. The left end of both ends of the bottom plate 22 is coupled to the lower end of the side plate 23 in the up and down direction 11, and the right end of the bottom plate 22 is coupled to the lower end of the side plates 24 in the up and down direction 11.

A maximum length L1 of the bottom plate 22 in the forward and backward direction 13 is longer than a maximum length L2 of the top plate 21 in the forward and backward direction 13. In other words, a part of the bottom plate 22 does not face the top plate 21 in the up and down direction 11. Hereinafter, a description is provided referring the part of the bottom plate 22 as an abutting part 32. The abutting part 32 is illustrated by a hatching in FIG. 2. The abutting part 32 abuts on the lower end of the resin faceplate 40 and positions the resin faceplate 40 in the up and down direction 11. Details are described later.

The top plate 21 has a plurality of fitting notches 33 fitted with protruding bodies 42 of the resin faceplate 40, which will be described later. The fitting notch 33 has a trapezoidal shape widening toward a rear end of the top plate 21 when viewed from the above. Peripheral surfaces of the fitting notches 33 abut on the protruding bodies 42 of the resin faceplate 40 in the left and right direction 12, and position and fix the resin faceplate 40 in the left and right direction 12. Furthermore, the peripheral surfaces of the fitting notches 33 fitted with the protruding bodies 42 of the resin faceplate 40 in the left and right direction 12 suppress an expansion and contraction of the resin faceplate 40 in the left and right direction 12 due to a change in an environmental temperature. In other words, a length change of the resin faceplate 40 in the left and right direction 12 is suppressed by the metal frame 20 having a smaller expansion and contraction rate due to the change in the environmental temperature than resin.

The number of the fitting notches 33 is determined in accordance with the size of the foundation formwork 10. Specifically, the number of the fitting notches 33 is determined so that an accuracy of the foundation to be placed is within an error range of a design specification regarding the length change of the resin faceplate 40 in the left and right direction 12. In the illustrated example, the top plate 21 has five fitting notches 33. The fitting notch 33 is an example of a recessed part.

Figure 3:
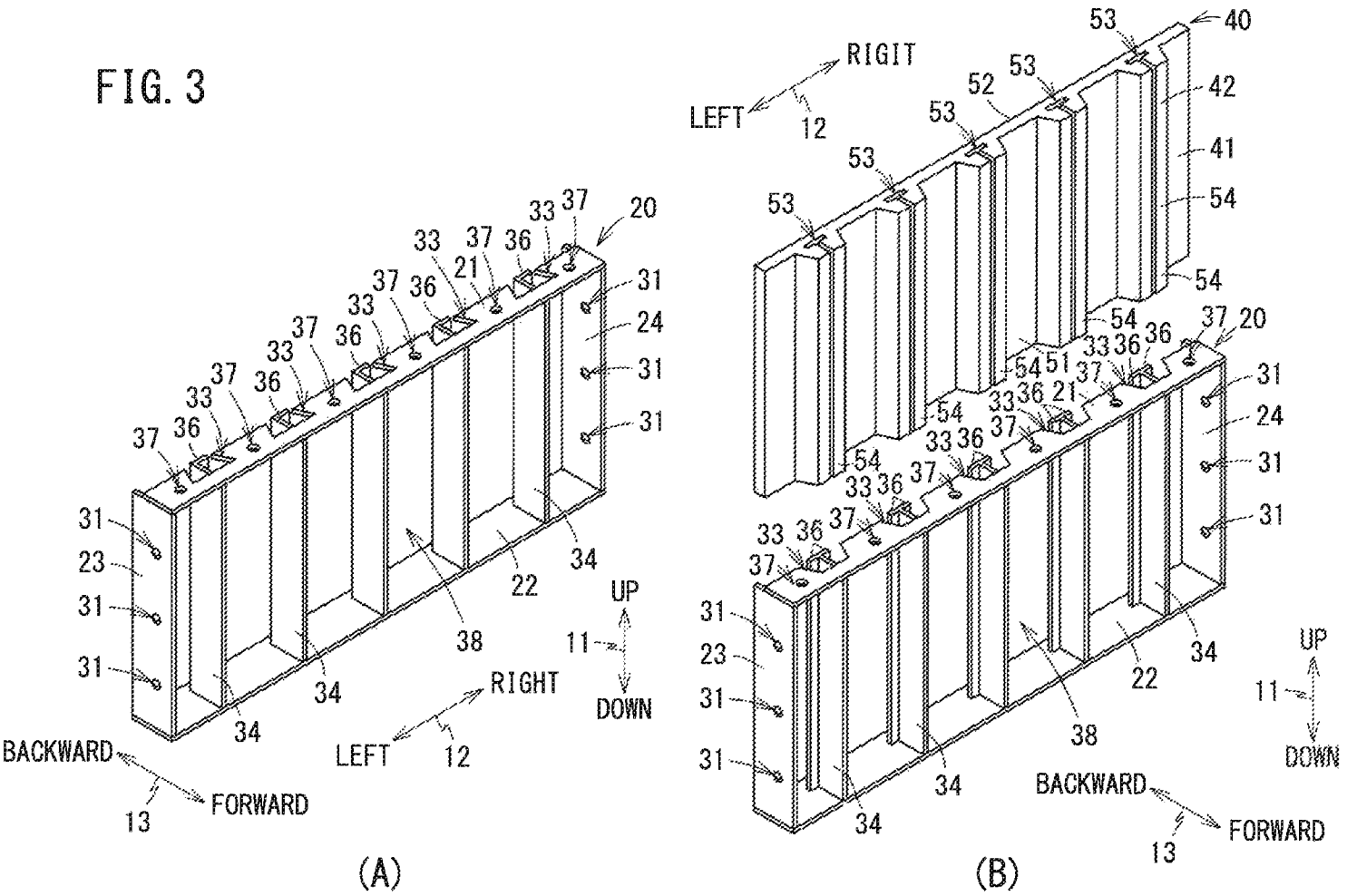
FIG. 3(A) is a view illustrating another shape of fitting notches 33 in a metal frame 20.
FIG. 3(B) is a view illustrating another shapes of slits 53 of a resin faceplate 40 and bridged bodies 34 of the metal frame 20.

Note that although the fitting notch 33 has the trapezoidal shape when viewed from the above in the illustrated example, the fitting notch may have a rectangular shape or may have a trapezoidal shape narrowing toward the rear end of the top plate 21 as illustrated in FIG. 3(A).

The top plate 21 has a plurality of attachment holes 37 for positioning and attaching anchor rulers 15 (FIG. 4) to the foundation formwork 10. The attachment hole 37 is a through hole penetrating the top plate 21 in the up and down direction 11, which is a thickness direction.

As illustrated in FIG. 4, the anchor ruler 15 has a plate shape having a plurality of first insertion holes 17 having substantially the same diameter as that of the attachment hole 37 and a plurality of second insertion holes (not illustrated) for suspending anchor bolts 16. The anchor ruler 15 is bridged between the top plates 21 of a pair of foundation formworks 10 arranged facing each other in the forward and backward direction 13. At this time, the anchor ruler 15 is arranged so that the first insertion holes 17 of the anchor ruler 15 and the attachment holes 37 of the top plates 21 of the foundation formworks 10 vertically overlap. Fixing pins (not illustrated) are inserted through the first insertion holes 17 and the attachment holes 37 overlapping vertically. The anchor ruler is positioned and fixed to the foundation formworks 10 by the fixing pins. The anchor bolts 16 are inserted from below through the second insertion holes of the anchor ruler 15 bridged between the pair of foundation formworks 10. By fastening nuts (not illustrated) to the inserted anchor bolts 16, the anchor bolts 16 are suspended from the anchor ruler 15. In other words, the anchor bolts 16 are positioned by the attachment holes 37 of the top plate 21 of the foundation formworks 10 through the anchor ruler 15. Being formed of a metal, such as a steel material, the metal frame 20 has a smaller expansion rate and a smaller contraction rate than those of resin. Therefore, the foundation formwork 10 can improve a positional accuracy of the installation of the anchor bolts 16 than a conventional foundation formwork entirely formed of resin.

As illustrated in FIGS. 1 and 2, the metal frame 20 further includes a plurality of bridged bodies 34. The bridged bodies 34 are bridged across the top plate 21 and the bottom plate 22. Specifically, the upper ends of the bridged bodies 34 are coupled to the lower surface of the top plate 21 by welding or the like. The lower ends of the bridged bodies 34 are coupled to the upper surface of the bottom plate 22 by welding or the like. The bridged bodies 34 bridged across the top plate 21 and the bottom plate 22 increase strength of the metal frame 20.

The same number of the bridged bodies 34 as the number of the fitting notches 33 are provided to the metal frame 20. Each of the bridged bodies 34 is provided so that a rear end part is located below the fitting notch 33. Hereinafter, description is provided referring the rear end part of the bridged body 34 located below the fitting notch 33 as a fitting-in end part 35. The fitting-in end part 35 is illustrated by a hatching in FIG. 2. The fitting-in end parts 35 are fittingly inserted into slits 53 of the protruding bodies 42 of the resin faceplate 40 from the above through the fitting notches 33. The fitting-in endparts 35 fittingly inserted into the slits 53 abut on the peripheral surfaces of the slits 53 in the left and right direction 12 and position and fix the resin faceplate 40 in the left and right direction 12. Details are described later. The fitting-in end part 35 is an example of a first piece.

Fitting-in pieces 36 extend along the left and right direction 12 from the rear ends of the fitting-in end parts 35 in the forward and backward direction 13. The fitting-in end part 35 and the fitting-in piece 36 have an L-shape when viewed from the above. The fitting-in pieces 36 are fittingly inserted into the L-shaped slits 53 of the protruding bodies 42 of the resin faceplate 40 together with the fitting-in end parts 35. The fitting-in pieces 36 fittingly inserted into the slits 53 abut on the peripheral surfaces of the slits 53 in the forward and backward direction 13 and position and fix the resin faceplate 40 in the forward and backward direction 13. In other words, the metal frame 20 positions and fixes the resin faceplate 40 in the up and down direction 11, the left and right direction 12, and the forward and backward direction 13 by the abutting part 32 of the bottom plate 22, the fitting notches 33 of the top plate 21, and the fitting-in end parts 35 and the fitting-in pieces 36 of the bridged bodies 34. The bridged body 34 is an example of a first fitting part. The fitting-in piece 36 is an example of a second piece.

The resin faceplate 40 includes a faceplate main body 41 having a rectangular plate shape and a plurality of protruding bodies 42 protruding from the faceplate main body 41. The resin faceplate 40 is formed by pouring a molten resin material into a die, for example. In other words, the faceplate main body 41 and the protruding bodies 42 are formed integrally.

The length of the faceplate main body 41 in the forward and backward direction 13, i.e., the thickness of the faceplate main body 41, is substantially the same as the length of the abutting part 32 of the bottom plate 22 in the forward and backward direction 13. The lower end of the faceplate main body 41 abuts on the abutting part 32 (FIG. 1).

The length of the faceplate main body 41 in the up and down direction 11, i.e., the height of the faceplate main body 41, is substantially the same as the height from the upper surface of the bottom plate 22 to the upper surface of the top plate 21 in the metal frame 20. In other words, the upper end surface of the faceplate main body 41 of the resin faceplate 40 arranged so that the lower end abuts on the abutting part 32 of the bottom plate 22 is located at the same height position as that of the upper surface of the top plate 21 (FIG. 1). Therefore, no steps are formed in the upper surface of the foundation formwork 10. Since no steps are formed, the foundation formwork 10 is prevented from being caught by other materials during transportation of the foundation formwork 10, and a durability of the foundation formwork 10 is improved.

The length of the faceplate main body 41 in the left and right direction 12 is substantially the same as the distance between both inner side surfaces of the pair of left and right side plates 23, 24 of the metal frame 20. The left end of the faceplate main body 41 abuts on the inner side of the sideplate 23, and the right end surface of the faceplate main body 41 abuts on the inner side surface of the side plate 24. The left and right end surfaces of the faceplate main body 41 abut on the inner side surfaces of the side plates 23, 24, thereby the expansion and contraction of the resin faceplate 40 in the left and right direction 12 can be suppressed.

The resin faceplate 40 having the lower end abutting on the bottom plate 22 of the metal frame 20, the upper end that is flush with the upper surface of the top plate 21 of the metal frame 20, and both the left and right ends abutting on the left and right side plates 23, 24 of the metal frame 20 closes the opening 38 of the metal frame 20. In other words, the foundation formwork 10 in which the opening 38 of the metal frame 20 is closed enables the placement of the foundation.

A main surface 52, which is one of a pair of main surfaces 51, 52 of the faceplate main body 41 having the plate shape, is not provided with the protruding bodies 42 and is a flat plane. The pair of foundation formworks 10 is installed with the main surfaces 52 facing each other, as illustrated in FIG. 4. Then, concrete is poured between the two main surfaces 52 of the pair of foundation formworks 10, and a foundation is placed. In other words, the main surface 52 of the faceplate main body 41 is a surface receiving the concrete.

Note that on the main surface 52 of the faceplate main body 41, recesses or protrusions for forming figures configured by the protrusions or recesses may be formed on the side surface of the foundation. In other words, the foundation formwork 10 may have a function of applying a design to the side surface of the foundation to be placed. In this case, the foundation formwork 10 is a so-called decorative formwork. Since the faceplate main body 41 is formed of resin, the recesses or protrusions can be easily formed on the main surface 52 by providing protrusions or recesses on a surface of the die.

The main surface 52 of the faceplate main body 41 and the end surfaces of the side plates 23, 24 of the metal frame 20 in the forward and backward direction 13 are flush with each other so that no steps are formed in an outer surface of the foundation to be placed.

As illustrated in FIGS. 1 and 2, the protruding body 42 protrudes forward from the main surface 51, which is the other one of the pair of main surfaces 51, 52 of the faceplate main body 41. Furthermore, the protruding body 42 extends from the upper end to the lower end of the faceplate main body 41. The protruding body 42 has a shape capable of being fitted with the fitting notch 33 provided to the top plate 21 of the metal frame 20. Specifically, the protruding body 42 has a trapezoidal shape narrowing toward the front end when viewed from the above.

The protruding body 42 fitted with the fitting notch 33 of the top plate 21 abuts on the peripheral surface of the fitting notch 33 of the top plate 21 in the left and right direction 12. Therefore, the resin faceplate 40 is positioned and fixed to the metal frame 20 in the left and right direction 12, and further the expansion and contraction in the left and right direction 12 are suppressed. In other words, the resin faceplate 40 is positioned and fixed in the left and right direction 12, and further the expansion and contraction are suppressed, by the top plate 21 and the side plates 23, 24 of the metal frame 20.

The protruding body 42 has the L-shaped slit 53 into which the fitting-in end part 35 and the fitting-in piece 36 of the bridged body 34 of the metal frame 20 are fittingly inserted. The slit 53 is provided from the upper end to the lower end of the protruding body 42. In other words, the slit 53 is opened to a protruding surface 54, an upper end surface, and a lower end surface of the protruding body 42. The fitting-in end part 35 and the fitting-in piece 36 of the bridged body 34 are fittingly inserted into the slit 53 through an opening of the protruding surface 54 and an opening of the lower end surface of the protruding body 42. Note that the slit 53 may not have an opening in the upper end surface of the protruding body 42. However, considering the forming of the resin faceplate 40, it is preferable that the slit 53 have an opening in the upper end surface of the protruding body 42. The slit 53 is an example of a second fitting part.

In the left and right direction 12, the peripheral surfaces of the slits 53 of the protruding bodies 42 abut on the fitting-in end parts 35 of the bridged bodies 34 that are fittingly inserted. In other words, the protruding bodies 42 abut on the bridged bodies 34 and the top plate 21 in the left and right direction 12, thereby the resin faceplate 40 is positioned and fixed in the left and right direction 12, and further the expansion and contraction in the left and right direction 12 are suppressed.

In the forward and backward direction 13, the peripheral surfaces of the slits 53 of the protruding bodies 42 abut on the fitting-in pieces 36 of the bridged bodies 34 that are fittingly inserted. In other words, the protruding bodies 42 abut on the fitting-in pieces 36 of the bridged bodies 34 in the forward and backward direction 13, thereby the resin faceplate 40 is positioned and fixed in the forward and backward direction 13.

Next, work of attaching the resin faceplate 40 to the metal frame 20 to assemble the foundation formwork 10 is described. A worker lowers the resin faceplate 40 from above the metal frame 20. The protruding bodies 42 of the lowered resin faceplate 40 enter downward from the fitting notches 33 of the top plate 21. At that time, the fitting-in end parts 35 and the fitting-in pieces 36 of the bridged bodies 34 of the metal frame 20 are fittingly inserted into the slits 53 of the protruding bodies 42 of the resin faceplate 40. The resin faceplate 40 is lowered to a position in which the lower end of the faceplate main body 41 abuts on the abutting part 32 of the bottom plate 22 of the metal frame 20 and the upper end of the faceplate main body 41 is flush with the upper surface of the top plate 21 of the metal frame 20. Note that the assembling work is performed in a room in which the temperature is kept at a constant temperature, such as 20° C., so that the resin faceplate 40 can be assembled to the metal frame 20. Alternatively, the resin faceplate 40 is left for a predetermined period in a thermostat bath or a room in which the temperature is kept at a constant temperature, such as 20° C., and then assembled to the metal frame 20.

When the resin faceplate 40 deteriorates due to the placement of the foundation or a deterioration with time, the resin faceplate 40 is removed from the metal frame 20 by a worker. The worker removes the resin faceplate 40 from the metal frame 20 by pulling the resin faceplate 40 upward from the metal frame 20. After removing the deteriorated resin faceplate 40 from the metal frame 20, the worker attaches a new resin faceplate 40 to the metal frame 20. Note that the metal frame 20 which is formed of a steel material and most of which does not directly contact with concrete takes a longer time to deteriorate than the resin faceplate 40 formed of resin.

Next, the placement of the foundation using the foundation formwork 10 is described with reference to FIG. 4. A worker installs a plurality of foundation formworks 10 on an installation tool (not illustrated) installed on the ground, a leveling concrete, or the like while coupling the plurality of foundation formworks 10 in the left and right direction 12. The plurality of foundation formworks 10 installed on the installation tool and coupled to each other and the plurality of foundation formworks 10 similarly installed on the installation tool and coupled to each other face each other in the forward and backward direction 13. At that time, the foundation formworks 10 are installed in a direction in which the flush main surfaces 52 of the faceplate main bodies 41 of the resin faceplates 40 face each other.

The worker bridges the anchor rulers 15 between the top plates 21 of the pair of foundation formworks 10 facing each other. The worker inserts the fixing pins through the first insertion holes 17 of the bridged anchor rulers 15 and the attachment holes 37 of the top plates 21 of the foundation formworks 10 to position and fix the anchor rulers 15.

The worker inserts the anchor bolts 16 from below through the second insertion holes of the anchor rulers 15 bridged between the pair of foundation formworks 10, fastens the nuts (not illustrated) to the anchor bolts 16, and suspends the anchor bolts 16 from the anchor rulers 15. Thereafter, the worker pours concrete between the facing foundation formworks 10 to place the foundation.

After placing the foundation, the worker removes the foundation formwork 10 from the foundation while integrating the metal frame 20 and the resin face plan 40. In other words, since the metal frame 20 and the resin face plan 40 are integrally assembled, it is not necessary to separately remove the metal frame 20 and the resin faceplate 40 from the foundation. Therefore, when removed from the foundation, the foundation formwork 10 can be handled in the same manner as the conventional foundation formwork entirely formed of metal, and is easy to handle.

Actions and Effects of the Present Embodiment

In the present embodiment, the foundation formwork 10 is configured by the metal frame 20 and the resin faceplate 40 attached to the metal frame 20. Therefore, the foundation formwork 10 of the present embodiment is lighter than the conventional foundation formwork entirely formed of metal. Being lighter than the conventional foundation formwork, the foundation formwork 10 of the present embodiment is easy to handle. In other words, the foundation formwork 10 of the present embodiment can facilitate work of a worker installing the foundation formwork 10. Furthermore, in the foundation formwork 10 of the present embodiment, since a frame part having the rectangular frame shape is formed of metal, a dimensional change due to the environmental temperature is small. In other words, in the foundation formwork 10, the frame part having the rectangular frame shape is formed of metal and a faceplate part closing an opening of the frame formed of metal is formed of resin, thereby the dimensional change due to the environmental temperature is smaller than the conventional foundation formwork entirely formed of resin. As a result, the foundation formwork 10 of the present embodiment can place a more accurate foundation than the conventional foundation formwork entirely formed of resin. An accurate foundation means a foundation with a small error in installation positions of the anchor bolts 16 in the left and right direction, for example.

The protruding bodies 42 of the resin faceplate 40 are fitted with the fitting notches 33 of the top plate 21 of the metal frame 20 and the fitting-in end parts 35 and the fitting-in pieces 36 of the bridged bodies 34 of the metal frame 20 are fittingly inserted into the slits 53 of the protruding bodies 42, thereby the resin faceplate 40 of the foundation formwork 10 is attached to the metal frame 20. In other words, the resin faceplate 40 is detachably attached to the metal frame 20. Therefore, the resin faceplate 40 can be easily replaced with a new resin faceplate 40 when deteriorated or damaged.

In the present embodiment, the protruding bodies 42 extending in the up and down direction 11 are provided to the resin faceplate 40, the slits 53 extending in the up and down direction 11 are provided to the protruding bodies 42, and the resin faceplate 40 is lowered from the above to the below so that the resin faceplate 40 is attached to the metal frame 20. Therefore, the resin faceplate 40 and the metal frame 20 can be caused to abut on each other in the left and right direction 12. As a result, the expansion and contraction of the resin faceplate 40 in the left and right direction 12 can be suppressed by the metal frame 20.

Note that the expansion and contraction of the resin faceplate 40 in the up and down direction 11 do not affect a design accuracy of the foundation to be placed. In other words, the expansion and contraction of the resin faceplate 40 in the up and down direction 11 are allowed.

The fitting-in end parts 35 of the bridged bodies 34 abut on the peripheral surfaces of the slits 53 in the left and right direction 12, thereby the resin faceplate 40 is fixed to the metal frame 20 in the left and right direction 12, and the fitting-in pieces 36 of the bridged bodies 34 abut on the peripheral surfaces of the slits 53 in the forward and backward direction 13, thereby the resin faceplate 40 is fixed to the metal frame 20 in the forward and backward direction 13. In other words, the resin faceplate 40 is provided with the L-shaped slits 53 and the metal frame 20 is provided with the L-shaped bridged bodies 34, thereby the resin faceplate 40 can be fixed to the metal frame 20 in the left and right direction 12 and the forward and backward direction 13.

In the present embodiment, the fitting notches 33 are provided to the top plate 21 of the metal frame 20 and the protruding bodies 42 fitted with the fitting notches 33 are provided to the resin faceplate 40. The peripheral surface of the fitting notch 33 and the protruding body 42 abut on each other in the left and right direction 12. Therefore, the expansion and contraction in the left and right direction 12 of the resin faceplate 40 due to the environmental temperature are further suppressed by the fitting notches 33 and the protruding bodies 42.

Modification Examples

In the above-described embodiment, there is described an example in which the bridged body 34 of the metal frame 20 and the slit 53 of the resin faceplate 40 have the L-shape when viewed from the above. However, the bridged body 34 and the slit 53 may have shapes other than the L-shape insofar as the bridged body 34 is fittingly insertable into the slit 53 and the resin faceplate 40 can be fixed to the metal frame 20 in the left and right direction 12 and the forward and backward direction 13. For example, the bridged body 34 and the slit 53 may have a T-shape when viewed from the above as illustrated in FIG. 3(B) or may have other shapes.

In the above-described embodiment, there is described an example in which the fitting notches 33 are provided only to the top plate 21. However, the fitting notches 33 may be provided to the bottom plate 22 in addition to the top plate 21 or in place of the top plate 21. In this case, the lower end of the protruding body 42 of the resin faceplate 40 are extended below the lower end of the faceplate main body 41 by the thickness of the bottom plate 22 of the metal frame 20. In other words, the protruding body 42 abuts on the peripheral surface of the fitting notch 33 provided to the bottom plate 22 of the metal frame 20, in the left and right direction 12. The protruding bodies 42 abut on the peripheral surfaces of the fitting notches 33 provided to the bottom plate 22 in the left and right direction 12, thereby the expansion and contraction of the resin faceplate 40 in the left and right direction 12 are further suppressed.

In the above-described embodiment, there is described an example in which both the left and right ends of the faceplate main body 41 of the resin faceplate 40 abut on the inner side surfaces of the left and right side plates 23, 24 of the metal frame 20. However, in a case in which it is allowed to form protrusions on the side surface of the foundation, both the left and right ends of the faceplate main body 41 of the resin faceplate 40 may be separated from the inner side surfaces of the left and right side plates 23, 24 of the metal frame 20. In that case, the expansion and contraction of the resin faceplate 40 in the left and right direction 12 can be suppressed by fitting the fitting notches 33 with the protruding bodies 42. In other words, an accuracy of the foundation required for an execution of a building is secured.

In the above-described embodiment, there is described an example in which the resin faceplate 40 is configured by one member. However, the resin faceplate 40 may be configured by two or more members to reduce the size of a die for forming or to enable use of a smaller forming machine. For example, the resin faceplate 40 may be configured by an upper divided body and a lower divided body obtained by vertically dividing into two. In this case, after the lower divided body is assembled to the metal frame 20, the upper divided body is assembled to the metal frame 20. The upper divided body and the lower divided body may be coupled using a coupling tool, or may not be coupled.

DESCRIPTION OF REFERENCE CHARACTERS

10 foundation formwork
15 anchor ruler
16 anchor bolt
20 metal frame
21 top plate (upper and lower frame bodies)
22 bottom plate (upper and lower frame bodies)
23, 24 side plate (left and right frame bodies)
31 coupling hole
32 abutting part
33 fitting notch (recessed part)
34 bridged body (first fitting part)
35 fitting-in end part (first piece)
36 fitting-in piece (second piece)
40 resin faceplate
41 faceplate main body
42 protruding body
51, 52 main surface
53 slit (second fitting part)

The invention claimed is:

1. A foundation formwork comprising:
a metal frame having a rectangular frame shape; and
a resin faceplate attached to the metal frame and closing an opening of the metal frame;
wherein the metal frame has a first fitting part being one of a pair of fitting parts fitted with each other, and the resin faceplate has a second fitting part being another one of the pair of fitting parts; and
wherein the metal frame has:
a pair of left and right frame bodies facing each other in a horizontal direction when put on a ground;
a pair of upper and lower frame bodies facing each other in a vertical direction when put on the ground; and
a bridged body bridged between the pair of upper and lower frame bodies along the left and right frame bodies, the bridged body being the first fitting part,
the resin faceplate has:
a faceplate main body having a plate shape; and
a protruding body protruding from a main surface of the faceplate main body, and
the second fitting part is a slit provided from one end to another end of the protruding body and configured so that the bridged body is fittingly insertable from a side of the one end.

2. The foundation formwork according to claim 1, wherein
the bridged body has:
a first piece abutting on a peripheral surface of the slit in a left and right direction being a direction along which the upper and lower frame bodies follow; and
a second piece abutting on the peripheral surface of the slit in a forward and backward direction orthogonal to both an up and down direction along which the left and right frame bodies follow and the left and right direction.

3. The foundation formwork according to claim 1, wherein at least one of the upper and lower frame bodies has a recessed part configured to allow the protruding body to be fitted and having a peripheral surface abutting on the protruding body in a left and right direction being a direction along which the upper and lower frame bodies follow.

4. The foundation formwork according to claim 2, wherein at least one of the upper and lower frame bodies has a recessed part configured to allow the protruding body to be fitted and having a peripheral surface abutting on the protruding body in the left and right direction.

* * * * *